US008009433B2

(12) United States Patent
Ares

(10) Patent No.: US 8,009,433 B2
(45) Date of Patent: Aug. 30, 2011

(54) RADIO CONTROL DEVICE, ELECTRICAL ACTUATOR AND HOME AUTOMATION INSTALLATION INCLUDING SUCH A DEVICE

(75) Inventor: Claude Ares, Thyez (FR)

(73) Assignee: Somfy SAS, Cluses (FR)

( * ) Notice: Subject to any disclaimer, the term of this patent is extended or adjusted under 35 U.S.C. 154(b) by 863 days.

(21) Appl. No.: 12/071,281

(22) Filed: Feb. 19, 2008

(65) Prior Publication Data

US 2008/0212294 A1 Sep. 4, 2008

(30) Foreign Application Priority Data

Feb. 22, 2007 (FR) ..... 07 01272

(51) Int. Cl.
*H05K 5/00* (2006.01)

(52) U.S. Cl. ..... 361/752; 361/800; 361/730

(58) Field of Classification Search ..... 361/727, 361/730, 741, 752, 756, 790, 797, 800; 250/200, 250/206, 208.1, 548; 427/96.1; 439/188, 439/944

See application file for complete search history.

(56) References Cited

U.S. PATENT DOCUMENTS

| | | | | |
|---|---|---|---|---|
| 4,279,013 | A * | 7/1981 | Cameron et al. | 700/33 |
| 5,351,284 | A * | 9/1994 | Rogers | 455/562.1 |
| 5,990,646 | A | 11/1999 | Kovach | |
| 7,057,360 | B1 * | 6/2006 | Hsu | 318/105 |
| 7,151,464 | B2 * | 12/2006 | Ramus | 340/12.5 |
| 2004/0162040 | A1 | 8/2004 | Ramus | |

FOREIGN PATENT DOCUMENTS

| | | |
|---|---|---|
| EP | 0921266 A2 | 6/1999 |
| FR | 2794253 A1 | 12/2000 |
| FR | 2825498 | 12/2002 |
| WO | WO 02/097230 | 12/2002 |
| WO | WO 2005/011053 | 2/2005 |

* cited by examiner

*Primary Examiner* — Hung S Bui
(74) *Attorney, Agent, or Firm* — Dowell & Dowell, PC

(57) ABSTRACT

A radio control device used to control a motor for driving a mobile screen which includes a printed circuit to control the motor, power supply conductors for the motor and printed circuit, and an aerial which is connected to the printed circuit and coupled electromagnetically, with galvanic insulation, to at least one of the conductors. The device also includes a box in which the printed circuit, aerial and conductors are housed.

10 Claims, 5 Drawing Sheets

- O -

RADIO CONTROL DEVICE, ELECTRICAL ACTUATOR AND HOME AUTOMATION INSTALLATION INCLUDING SUCH A DEVICE

BACKGROUND OF THE INVENTION

1. Field of the Invention

This invention relates to a device for radio control of a motor for driving a mobile screen which is used in a home automation installation such as a roller blind or awning. The invention also concerns an electrical actuator, which includes such a device, for operating a closing screen, sun protection screen or projection screen, and a home automation installation which includes such a device.

2. Description of the Related Art

In the field of the home or buildings in general, it is more and more common to control remotely actuators which are supplied electrically by a low voltage network or the grid. One of the most appropriate means is to use radio transmission.

FR-A-2 825 498 describes a device which is controlled by radio frequency, and includes an aerial which is coupled electromagnetically, with galvanic insulation, to at least one conductor. To provide this electromagnetic coupling with galvanic insulation, the insulator of the conductor is used, and the aerial is positioned next to the conductor. It is proposed that the conductors and the aerial strand should be made to go through the same insulating sheath, which may be heat-shrinkable. This operation is not easy to carry out industrially. The conductors and the aerial, which can be rigid, are connected to the radio frequency printed circuit and must go through the same sheath. If a simple sheath is used, the coupling is not optimal, and gives a little flexibility to the assembly, which nevertheless necessitates the operation of insertion into the sheath. If the sheath is heat-shrinkable, the coupling is improved, but necessitates an additional operation of heating the sheath and positioning the conductors and aerial to be able to connect them easily to the printed circuit. As a variant, the coupling is made directly on the printed circuit. A conductor includes one portion which is implemented by a printed circuit track which extends parallel to another track which forms the aerial. The galvanic insulation is then obtained by the distance between the two tracks. This solution occupies a significant amount of space on the printed circuit, which limits the options for adding electronic functions for the same size of printed circuit.

BRIEF SUMMARY OF THE INVENTION

These are the disadvantages which the invention is more particularly intended to remedy, by proposing a new radio control device which makes it possible to ensure a good electromagnetic coupling, with galvanic insulation, between an aerial and at least one conductor.

For this purpose, the invention concerns a device for radio control of a motor for driving a mobile screen, this device comprising a printed circuit to control the motor, power supply conductors for the motor and printed circuit, and an aerial which is connected to the printed circuit and coupled electromagnetically, with galvanic insulation, to at least one of the conductors. This device is characterised in that it also comprises:

- a box in which the printed circuit, aerial and conductors are housed, and
- means of positioning the aerial in this box, between one face of the printed circuit and the conductor to which this aerial is coupled.

A printed circuit is in the form of a plate, of low thickness, on which electronic components are placed. A "face" of the printed circuit, in the sense of this invention, designates the upper face, on which the components are arranged, or the lower face of the plate, and not its four edges, the width of which is the thickness of the plate. Preferably, the aerial is positioned between the lower face of the circuit and the conductor to which it is coupled.

Arranging the aerial inside the box makes possible a good electromagnetic coupling to the associated conductor, it being possible to align the aerial with this conductor, galvanic insulation being provided between these two elements. Dissociating the aerial and conductor from the printed circuit means that space is not occupied on the printed circuit for the radio transmission function. The dimensions of the printed circuit can therefore be optimised.

A monopole aerial is particularly suitable for this kind of device, because it makes it possible to limit the footprint of the device.

The aerial and/or conductor can be implemented by tracks in their coupling zone. "Track" is understood to mean a metallic strip of a length at least equal to the distance at which the aerial and conductor are coupled, that is, preferably close to a quarter of the wavelength corresponding to the desired radio frequency. The width of this metallic strip is at least five times greater than its thickness. If the aerial and conductor are formed by tracks in their coupling zone, the widths of these tracks are preferably approximately the same, to ensure a good electromagnetic coupling.

The coupling can also be improved by coupling means which are intended to hold the aerial towards the conductor in such a way as to optimise the distance between these two parts, the minimum distance being the thickness of a layer of insulator. These means thus ensure a better electromagnetic coupling. Preferably, these coupling means include at least one resilient component which presses against a face of the printed circuit and is capable of exerting on a support, which carries the aerial, an effort which is directed to the conductor coupled to this aerial, which makes it possible to exert the bringing nearer effort next to the aerial.

The positioning means can be an independent aerial support in which the aerial is housed. This sub-assembly being independent, it is then simple to change the length of the aerial of the device and to adapt to the desired radio frequency. For instance, for a frequency of 433 MHz, an aerial length corresponding to a quarter of the wavelength, i.e. 17 cm, will be used. For a frequency of 868 MHz, the aerial will measure 8 cm. A specific aerial support can be adapted to each aerial length, or make it possible to house aerials of different lengths.

The aerial support can be positioned relative to the box which supports the printed circuit and conductor, or relative to a box in two parts. The printed circuit is housed in the first part, whereas the second part supports the coupled conductor. These two parts are positioned relative to each other. In this embodiment, the aerial support is guided either relative to the first part, and therefore positioned relative to the printed circuit, or relative to the second part, and in this case positioned relative to the coupled conductor. These alternatives bring a little more flexibility to the assembly. For instance, if the aerial support is connected to the first part, the aerial can be connected, in particular, to the printed circuit before being assembled in the device. In the second case, the positioning of the aerial and conductor is direct, and the coupling can only be better.

To facilitate the assembly of the aerial on the printed circuit, the aerial support can be movable in the box in to a parallel direction to the length of the aerial. One end of the aerial comprises a pin which is intended to pass through the printed circuit through a hole which is provided for this purpose. The pin, which makes it possible to connect the aerial electrically to the printed circuit, is then soldered to the printed circuit. The pin must therefore be well positioned relative to the hole of the printed circuit at the moment of assembly, so as not to damage it. This alignment is ensured by the box, which positions the printed circuit and the aerial support. The degree of freedom of the aerial support as described above makes it possible to absorb the dimensional tolerances of the parts, which tend to misalign the axis of the pin relative to the axis of the hole. In the perpendicular direction to the length of the aerial, a limited play between the aerial support and the box can be provided in the pin, to obtain the same flexibility of assembly. If this play is too great, the effectiveness of the electrical coupling between the aerial and conductor can be affected. In particular, it is possible to arrange that the width of the support, taken perpendicular to the length of the aerial, is slightly less than the distance which separates two edges of a site which is made in the box to receive this support.

The mobility of the aerial support in to the parallel direction to the length of the aerial also makes it possible to bring flexibility to the siting of the components on the printed circuit. The hole through which the pin passes can thus be shifted on the printed circuit without the device having to be redesigned. If the hole is shifted in a parallel direction to the length of the aerial, it is enough just to shift the aerial support at the time of assembly. If it is shifted in another direction, the site of the pin of the aerial relative to the aerial support must be changed. This change can turn out to be more complex.

The invention also relates to an electrical actuator for operating a closing screen, sun protection screen or projection screen, this actuator comprising a motor for driving a component for moving a screen, and a radio control device as mentioned above.

Such an actuator is more reliable and more efficient than those of the prior art as far as transmission of radio signals to or from the printed circuit is concerned.

Finally, the invention concerns a home automation installation, e.g. an installation for closing, sun protection or operating a video screen, including at least one electric motor and a control device as mentioned above.

BRIEF DESCRIPTION OF THE DRAWINGS

The invention will be better understood on reading the following description, which is given as an example only and referring to the attached drawings, in which.

DESCRIPTION OF THE PREFERRED EMBODIMENTS

Figure 1:
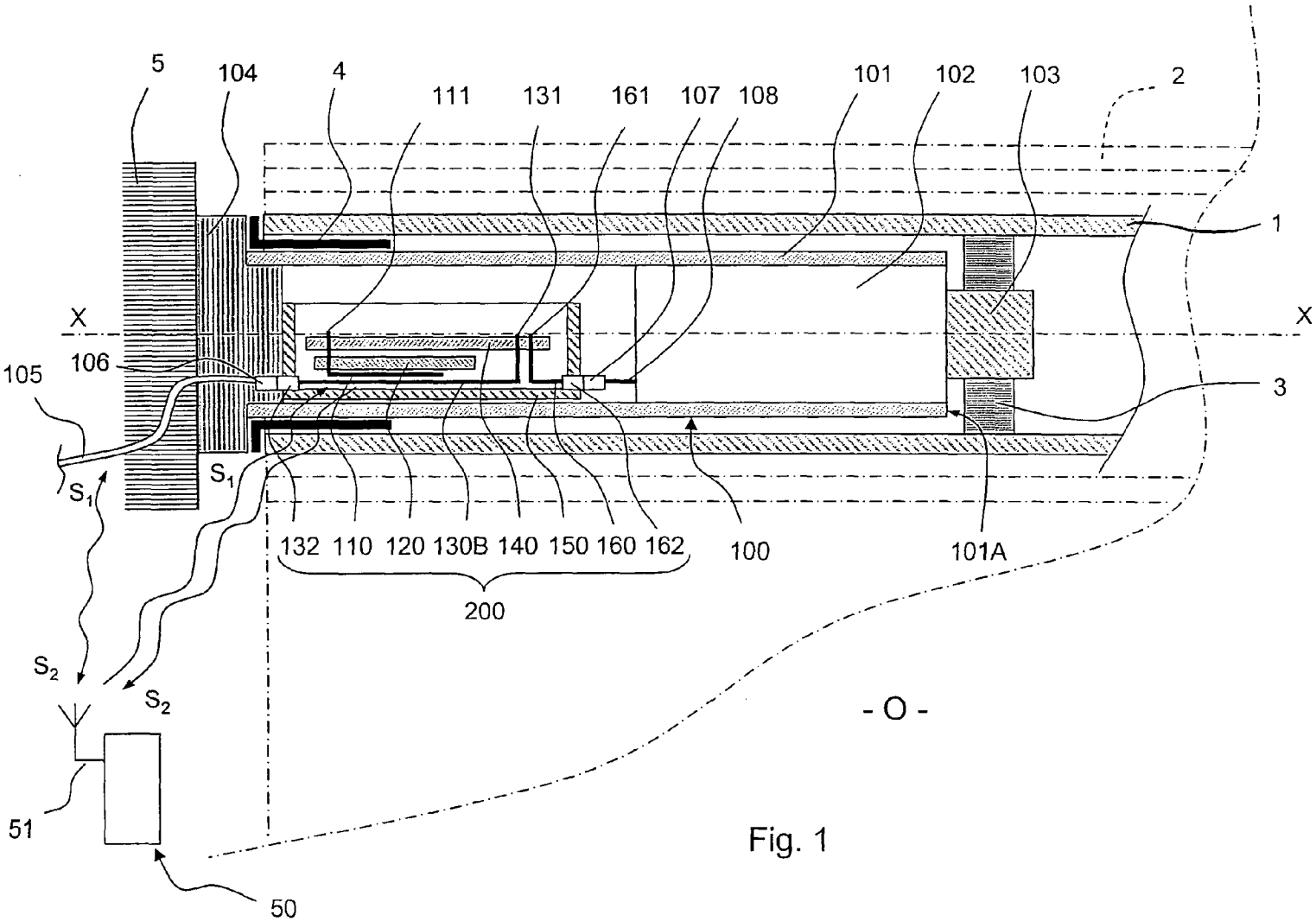
FIG. 1 is a schematic illustration of the architecture of a tubular actuator conforming to the invention.
Figure 2:
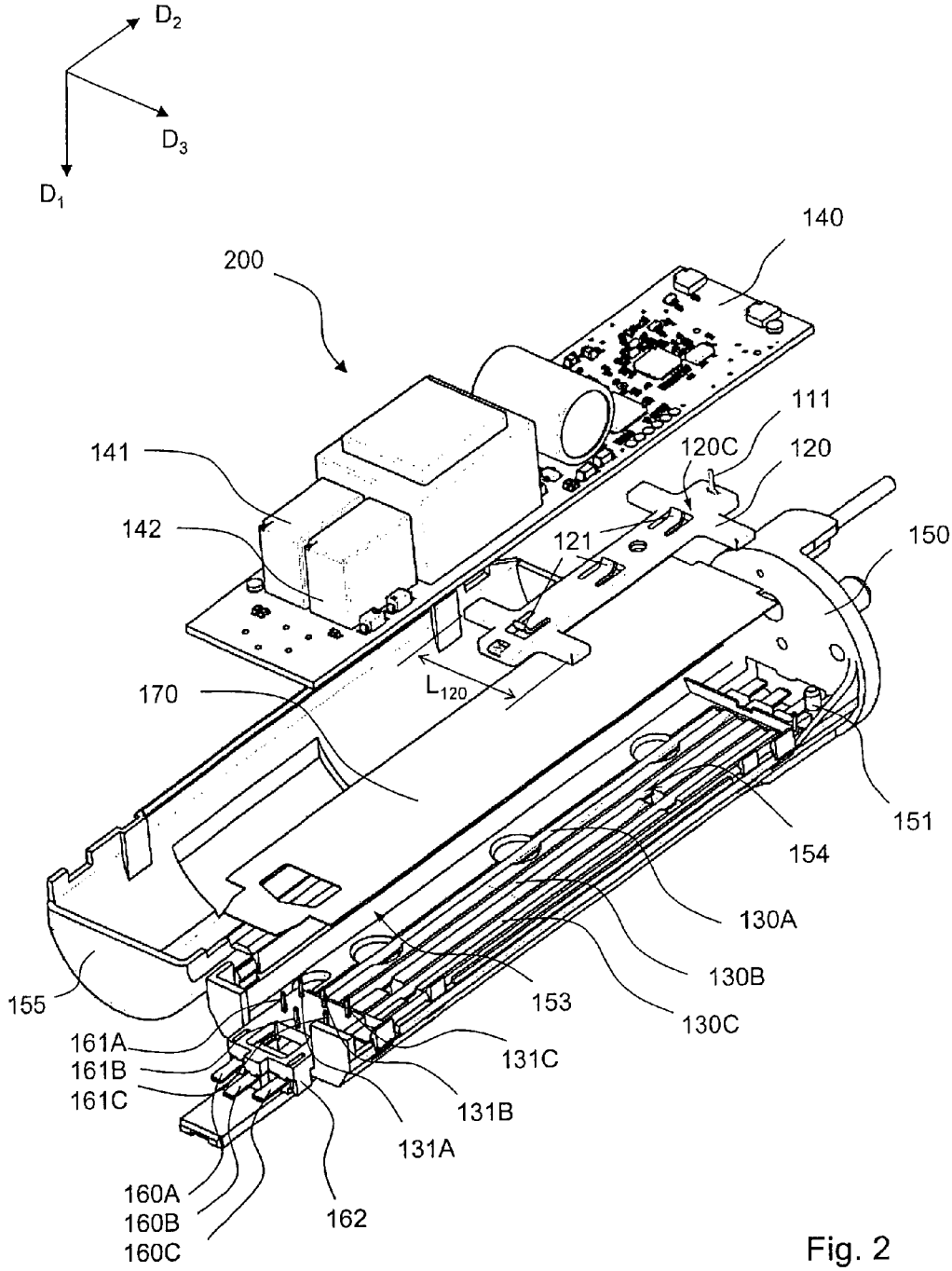
FIG. 2 is a perspective view of a radio control device belonging to the actuator of FIG. 1.
Figure 3:
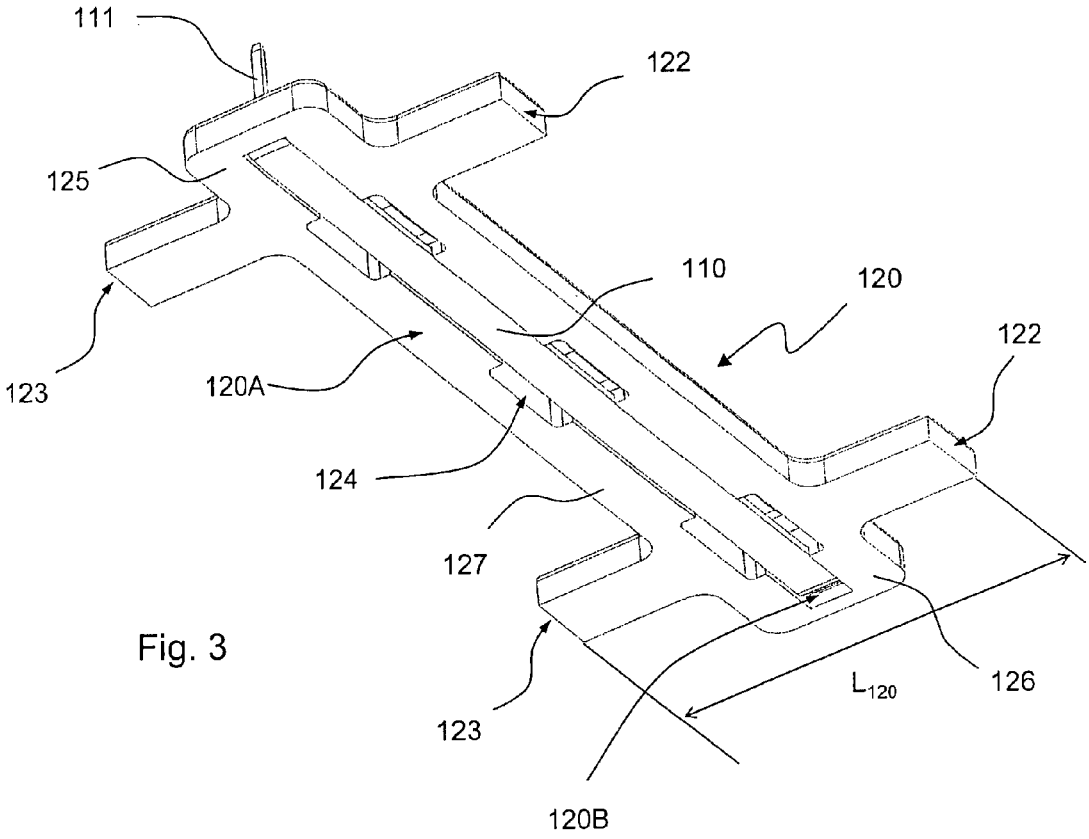
FIG. 3 is a perspective view of an aerial support which is equipped with an aerial and belongs to the device of FIG. 2.
Figure 4:
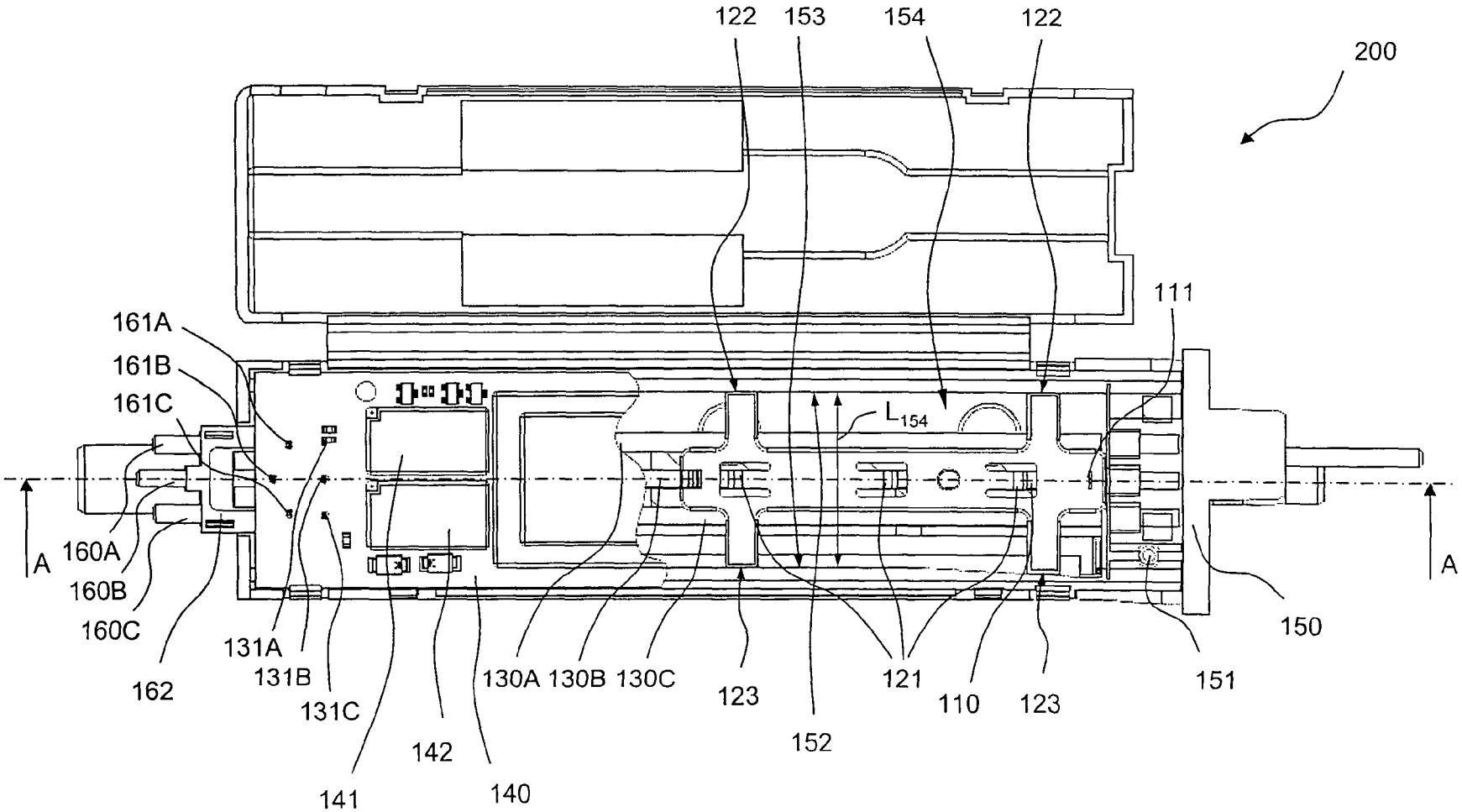
FIG. 4 is a partly torn away plan view of the assembled device of FIG. 2 before its cover is closed.

FIG. 1 shows a tubular actuator 100, which is intended to drive a roller tube 1, on which a fabric deck 2 for closing an opening O can be more or less rolled. The tube 1 is driven by the actuator 100 to rotate around an axis of revolution X-X which is disposed horizontally in the high part of the opening. The opening O is, for example, an opening which is made in the walls of a building. The actuator 100, the tube 1 and the fabric deck 2 then form a motorised roller blind.

The actuator 100 comprises a cylindrical tube 101, in which is fitted a geared motor 102, comprising a motor, a brake and a reduction gear, and equipped with an output shaft 103 which projects at one end 101A of the tube 101, and drives a rotationally integral wheel rim 3 of the tube 1.

The roller tube 1 rotates around the axis X-X and fixed tube 101 by means of two pivot links. A bearing rim 4, which is mounted on the exterior periphery of the tube 101, provides the first pivot link. The second pivot link is at the other end of the tube 1 and is not shown.

The actuator 100 also comprises a fixing piece 104, which projects at the opposite end of the tube from the output shaft and makes it possible to fix the actuator 100 on a frame 5. This fixing piece 104 is also intended to block the tube 101 and support a radio control device 200, which is housed inside the tube 101. A mains power supply cable 105, comprising three conductors, passes through the fixing piece 104 and is connected to the control device 200 via a connector 106, which is fitted at the end of the cable 105, on a connector 132 which is integral with a box 150 which belongs to the device 200. At the other end of the box 150, there is a second connector 162, to which another connector 107 is connected at the end of a power supply cable 108 of the geared motor 102.

The box 150 forms a housing, which protects, mechanically and electrically, the parts which it encloses. This box is placed in the tube 101 when the actuator 100 is assembled. If the actuator is not of tubular type, the box 150 can be installed in a different part of the installation, while still protecting the parts which it encloses.

The radio control device 200 is capable of receiving a signal $S_1$ which is carried by radio waves. This signal $S_1$, which is represented by a wavy arrow in FIG. 1, comes from a portable transmitter 50, which is equipped with an aerial 51. It carries the commands to operate the geared motor 102. These commands are then interpreted by the device 200, to supply power or not to the geared motor 102 by means of the cable 108, with a polarity which is a function of the desired direction of rotation of the tube 1.

The device 200 can also emit, the destination being the transmitter 50 or a control centre, and still by radio waves, a signal $S_2$ which contains information about the functioning of the geared motor 102.

To receive the radio waves coming from the transmitter 50 and forming the signal $S_1$, and to emit the waves forming the signal $S_2$, the device 200 includes a monopole aerial 110, which is connected to a printed circuit 140 and coupled electromagnetically to one of the three power supply conductors 130A, 130B and 130C which extend in the box 150 between the connectors 132 and 162. In the shown example, the aerial 110 is coupled to the conductor 130B, with galvanic insulation. In other words, at the radio frequencies which the circuit 140 uses, the aerial 110 and conductor 130B function together, at the electromagnetic level, like one aerial, although they are electrically insulated from each other. Thus the radio signals which the aerial 110 emits or receives are transmitted partly directly through the air and partly via coupling to the conductor 130B. It is even conceivable for that conductor of the cable 105 which is connected to the conductor 130B via the connectors 106 and 132 to participate in the transmission/reception of the radio signals $S_1$ and $S_2$, this being represented by the furthest left wavy arrow in FIG. 1, and for this to happen all the more when the actuator is housed in a metallic structure which interferes with the transmission/reception of the radio signals $S_1$ and $S_2$ with the aerial 110. However, because of the galvanic insulation between the conductor 130B and the aerial 110, the mains voltage is not transmitted to this aerial.

If a control command emitted by the remote control 50 is received, the signal $S_1$ is processed by the electronics of the printed circuit 140. Power is then supplied to the geared motor 102 depending on the received command.

The following are positioned in the box 150:

- power supply conductors 130A, 130B and 130C, which are connected to the connector 132 and connected to the printed circuit 140 via pins 131A, 131B and 131C,
- an aerial support 120, which carries the aerial 110, connected to the printed circuit 140 via a pin 111,
- the printed circuit 140, which is called "radio frequency" because it can process signals such as the $S_1$ signals which the aerial 110 receives and the $S_2$ signals which this aerial is to emit,
- plugs 160A, 160B and 160C, which belong to the connector 162, and are intended to supply power to the geared motor 102 and connected to the printed circuit 140 via pins 161A, 161B and 161C.

Since all these elements are arranged in the box 150, they can be positioned precisely relative to each other. In particular, the aerial 110, which is integral with the aerial support 120, can be installed in the box 150 while being in the vicinity of the conductor 130B, to ensure good electromagnetic coupling between these elements.

The pins 111, 131A, 131B, 131C, 161A, 161B and 161C are connected correctly to the printed circuit 140 using the same reference system, which is the box B.

Nevertheless, a slight play between these parts is necessary to make assembly easier.

When the tubular actuator 100 functions, the geared motor 102 drives the shaft 103 in rotation, and the shaft 103 in turn, via the wheel rim 3, drives the tube 1 in rotation.

For instance, when the actuator 100 is installed in a roller blind case, rotation of the shaft 103 drives the opening, and alternately the closing, of the opening O.

FIGS. 2, 3, 4 and 5 show, in more detail, the structure of the control device 200.

The three conductors of the power supply cable, i.e. two phase conductors and one neutral conductor, are connected on tracks which form the conductors 130A, 130B and 130C and are housed in the box 150. These tracks are metallic strips, the width of which is at least five times greater than their thickness. The length of these tracks is dimensioned so that they correspond to at least a quarter of the wavelength of the desired frequency. These tracks 130A, 130B and 130C are connected via the pins 131A, 131B and 131C to the printed circuit 140. The printed circuit 140 is thus supplied with mains power.

Depending on the received radio signal $S_1$, the circuit 140 supplies power to the plugs 160A, 160B and 160C of the output conductor 162, corresponding to the power which it is desirable to supply to the geared motor 102. The phase and neutral conductors are thus connected to the terminals of a winding of the motor, to rotate the motor in one direction. They are connected to the terminals of the other winding if rotation in the reverse direction is wanted. For instance, the track 130B can be connected to the plug 160B via the printed circuit 140 and the pins 131B and 161B. If a different command is transmitted, this track 130B can, for example, be connected to the plug 160A via the pin 131A. As a variant, the track 130A can be connected to the plug 160A while the track 130B is disconnected. These connections are implemented, for example, by relays 141 and 142, which are arranged on the printed circuit 140.

To insulate the conducting tracks 130A, 130B and 130C from the aerial 110 and printed circuit 140, an interleaved sheet of an insulating material 170, e.g. a sheet of "Mylar" (registered trade mark), is arranged between these tracks and this aerial.

The aerial 110 is fitted in the support 120, which is in the form of a double cross with six ends. The aerial 110 is formed by a track, the cross-section of which is approximately equivalent to that of the track 130B to which it is coupled. Its length corresponds to a quarter of the wavelength of the frequency which is used for radio communication by the device 200. Almost the whole of this length extends along the aerial support 120. The aerial 110 is received in a recess 124, which extends on a central bar 127 which connects the two crosses, and on two branches 125 and 126 which prolong the central bar. The aerial 110 is slightly recessed relative to the lower face 120A of the aerial support 120. At one end, the aerial 110 passes through the aerial support 120 and ends at the pin 111. At the other end, the aerial 110 is folded, to be inserted into a recess 120B of the aerial support 120, with the aim of holding the aerial 110 in tension and recessed in the aerial support 120.

Once it is assembled in the box 150, the aerial support 120 presses, in a direction $D_1$, on the insulating interleaving 170, and is guided in the box 150. It can move in a direction $D_2$, which is approximately parallel to the length of the aerial. In a direction $D_3$, which is perpendicular to the two previous ones, the aerial support 120 is intended to come to press on two faces 152 and 153 of the box 150. In fact, the width $L_{120}$ of the aerial support 120 is limited, on one side by the end faces 122 of two of its transverse branches, and on the other side by the end faces 123 of the other transverse branches. These faces 122 and 123 correspond to the opposite ends of the double cross.

When it is fitted in the box 150, the aerial support 120 is housed in a site 154 of width $L_{154}$ equal to the distance between the faces 152 and 153. The width $L_{120}$ of the support 120 being slightly less than the width $L_{154}$, the aerial support can practically not move in the direction $D_3$. The faces 122 abut against the face 152, and the faces 123 abut against the face 153.

The aerial is centred relative to the aerial support, i.e. centred relative to the width $L_{120}$. On the other hand, the track 130B, which is coupled to the aerial 110, is centred relative to the width $L_{154}$. Thus, in construction, the aerial 110 and track 130B are one above the other, an ideal position for obtaining a good electromagnetic coupling.

It is not necessary that the aerial 110 and track 130 should be exactly centred relative to the widths defined above. In fact, it is enough that these two elements are positioned relative to the faces 122, 123, 152 and 153 so that they are one above the other after assembly.

Figure 5:
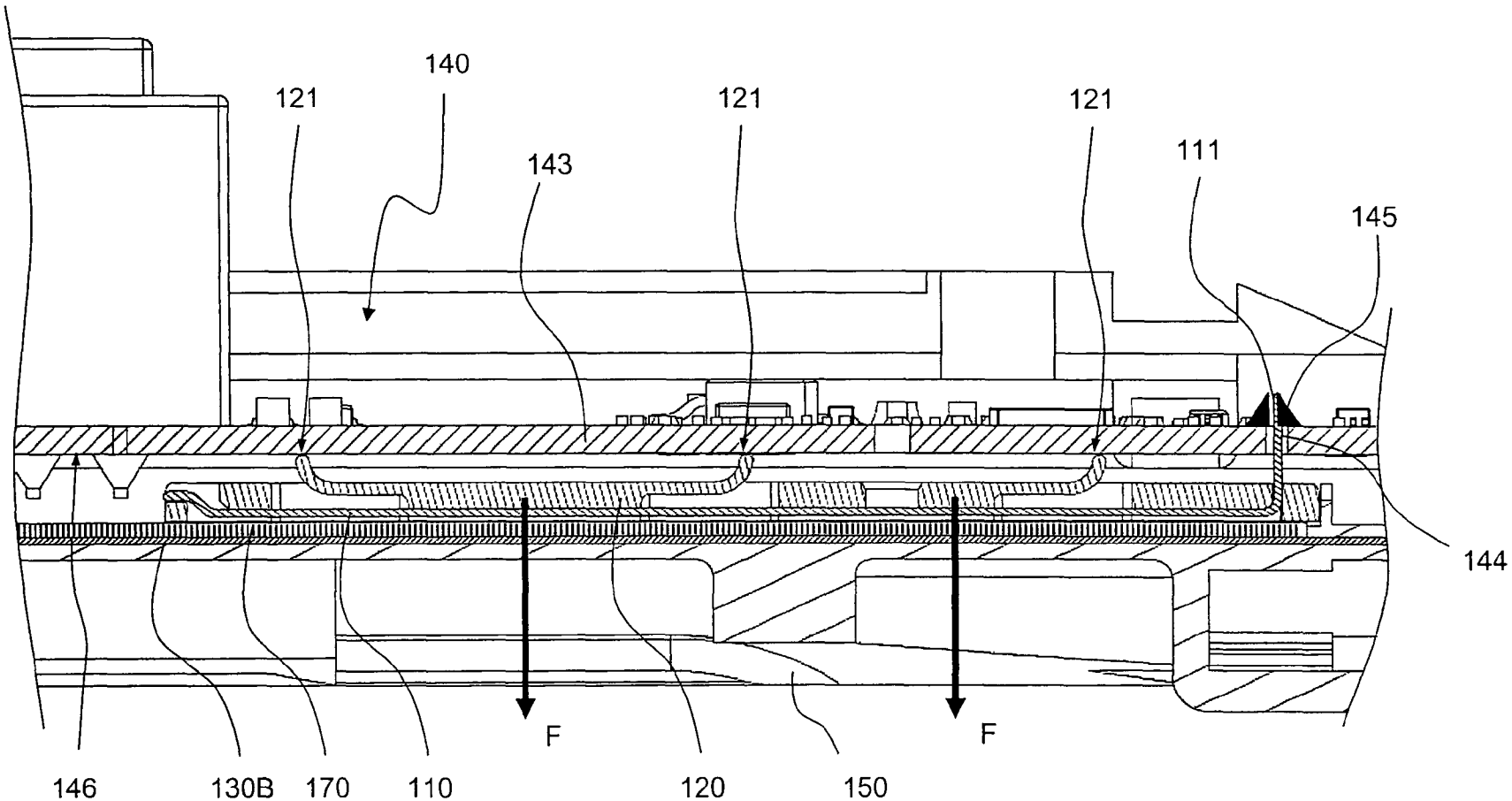
FIG. 5 is a partial cross-section along to the line A-A of FIG. 4.

After the support 120 is placed in the site 154, the printed circuit 140 covers the conducting tracks 130A, 130B and 130C and aerial support 120. It is positioned in the box by centring means, e.g. a centring pin 151. Once the printed circuit is arranged in the box 150, the pins of the conducting tracks 131A, 131B, 131C, 161A, 161B, 161C and the pin of the aerial 111 are soldered to the card 143 of this circuit, as illustrated in FIG. 5, by the soldering 145 of the pin 111 passing through a hole 144 of the card 143. The mobility of the aerial support 120 in the direction $D_2$ makes it possible to adjust the position of the pin 111 to align it with the axis of the hole 144, to make assembly and soldering easier.

To improve the electromagnetic coupling between the aerial 110 and the track 130, these two elements must be one above the other and the distance separating them must be as constant as possible. A solution for optimising this distance consists of giving the aerial support 120 resilient means 121 of pressing on the printed circuit 140. Three resilient lugs 121 are distributed along the aerial support 120, above the aerial 110, on the upper face 120C of the aerial support 120. These lugs 121 press on the lower face 146 of the card 143 of the printed circuit 140, and generate an effort F which tends to push the aerial support 120 against the insulating interleaved layer 170 and therefore towards the track 130B. The aerial 110, being slightly recessed from the lower face 120A of the aerial support 120, then approaches the track 130B. The coupling is thus improved.

The aerial 110 is thus positioned and held in place between the face 146 of the circuit 140 and the conductor 130B, in optimised magnetic coupling conditions.

When the support 120 and circuit 140 have been put in place as explained above, and after the electrical connections, a cover 155 of the box 150 can be pulled down over the circuit 140, closing the box 150. The elements which form the device 200 are thus protected from the external environment, in particular dirt and impacts.

It should be noted that the invention makes it possible to adapt the device 200 very easily to the wavelength of the signals $S_1$ and $S_2$, simply by adapting the length of the elements 110 and 120, which can be provided in several sizes, and of the electronic module. As a variant, the support 120 can be dimensioned to be able to house different sizes of aerial.

The control device 200 can also contain a mechanism (not shown) for counting the number of turns which the roller tube 1 makes during an operation.

The box 150 can be in several parts, which are positioned and assembled relative to each other. The box can also be formed by part of the fixing piece 104.

The invention has been represented with an aerial 110 and conductors 130A, 130B and 130C in the form of metallic tracks. As a variant, these elements can be in the form of conducting wires.

The invention has been described in the case where the mains power supply cable 105 comprises three conductors. As a variant, this cable can comprise only two conductors, while the geared motor 102 is supplied with single-phase current. In this case, the two conductors are connected to two tracks 130A, 130B or 130C. These two tracks are connected to the circuit 140. The electronic module then makes it possible to connect the conducting tracks to the plugs 160A, 160B and 160C depending on the received command.

The invention has been described in the case of its use for operating a roller blind. It can also be applied to operation of an awning, and more generally of any closing screen, sun protection screen or projection screen.

The invention claimed is:

1. A device for radio control of a motor for driving a mobile screen, the device comprising:

a printed circuit to control the motor, power supply conductors for the motor and the printed circuit, an aerial which is connected to the printed circuit and coupled electromagnetically, with galvanic insulation, to at least one of the conductors, a box in which the printed circuit, aerial and conductors are housed, and means for positioning the aerial in the box, between one face of the printed circuit and the conductor to which the aerial is coupled.

2. The device according to claim 1, wherein the aerial is a monopole aerial.

3. The device according to claim 1, wherein the aerial and/or the conductor coupled to the aerial is or are in the form of a conducting track in an electromagnetic coupling zone.

4. The device according to claim 1, wherein the means for positioning the aerial includes a support which carries the aerial, and which is positioned in a site which is made in the box so that the aerial can be connected to the printed circuit.

5. The device according to claim 4, wherein the support which carries the aerial can move relative to the box in a direction which is parallel to a length of the aerial.

6. The device according to claim 4, wherein a width of the support, taken perpendicularly to a length of the aerial, is slightly less than the distance which separates two edges of a site which is made in the box to receive the support.

7. The device according to claim 1, including at least one resilient component which presses against a face of the printed circuit and exerts on a support, which carries the aerial, an effort which is directed toward the conductor coupled electromagnetically to the aerial, this effort urging the aerial closer to the conductor.

8. The device according to claim 1, wherein a sheet of insulating material is interleaved between the conductors and the aerial.

9. An electrical actuator for operating a closing screen, sun protection screen or projection screen, the actuator comprising a motor for driving a component for moving the screen and a radio control device according to claim 1.

10. A home automation installation comprising at least one electric motor and a radio control device according to claim 1.

* * * * *